US007047937B2

(12) United States Patent
Frank et al.

(10) Patent No.: US 7,047,937 B2
(45) Date of Patent: May 23, 2006

(54) INTERNAL COMBUSTION ENGINE

(75) Inventors: Thomas Frank, Fellbach (DE); Andreas Hägele, Berglen (DE); Mohamed Abou-Aly, Walblingen (DE); Eberhard Schieber, Backnang (DE)

(73) Assignee: Andreas Stihl AG & Co KG (DE)

( * ) Notice: Subject to any disclaimer, the term of this patent is extended or adjusted under 35 U.S.C. 154(b) by 0 days.

(21) Appl. No.: 10/865,204

(22) Filed: Jun. 10, 2004

(65) Prior Publication Data

US 2004/0244769 A1 Dec. 9, 2004

(30) Foreign Application Priority Data

Jun. 11, 2003 (DE) ..... 103 26 313

(51) Int. Cl.
*F02D 41/16* (2006.01)
*G01M 15/00* (2006.01)

(52) U.S. Cl. ..... 123/339.11; 73/118.1; 123/339.13; 123/339.14

(58) Field of Classification Search ..... 123/339.11, 123/339.13, 339.1, 319, 339.14; 251/288, 251/284; 73/118.1
See application file for complete search history.

(56) References Cited

U.S. PATENT DOCUMENTS 4,200,596 A * 4/1980 Iiyama et al. ..... 261/65
6,014,954 A * 1/2000 Kleeman et al. ..... 123/339.13
6,134,984 A * 10/2000 Hisadomi ..... 74/502.2
6,189,506 B1 * 2/2001 Vanderveen ..... 123/337

FOREIGN PATENT DOCUMENTS

DE 75 19 322 6/1975

* cited by examiner

*Primary Examiner*—Tony M. Argenbright
(74) *Attorney, Agent, or Firm*—Robert W Becker & Associates; Robert W Becker

(57) ABSTRACT

An internal combustion engine is provided, and has a throttle element mounted in the intake channel of the engine so as to be pivotable, via a throttle shaft, between an idling position and a full-load position. An abutment is fixedly connected with the throttle shaft. In the idling position, the abutment rests against a stop element that is fixed in position on the intake channel. The stop element is adjustable and establishes the idling position of the throttle element. The abutment forms, with the stop element, a switch that is actuated in the idling position of the throttle element.

22 Claims, 6 Drawing Sheets

Fig. 2
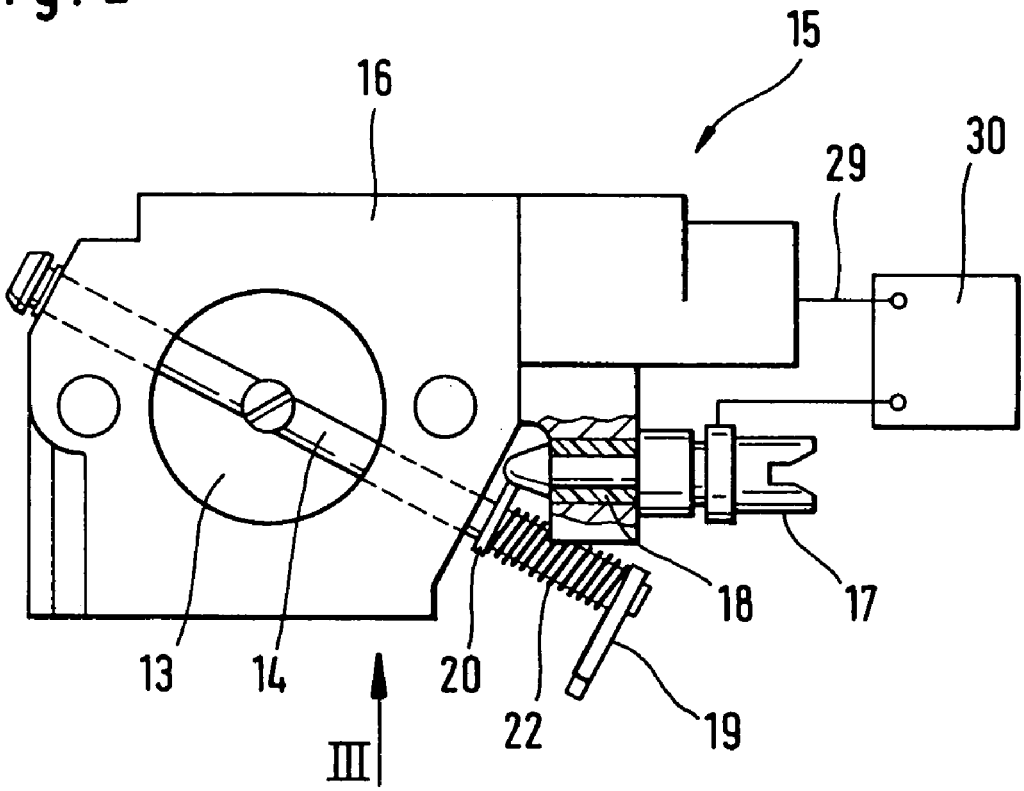
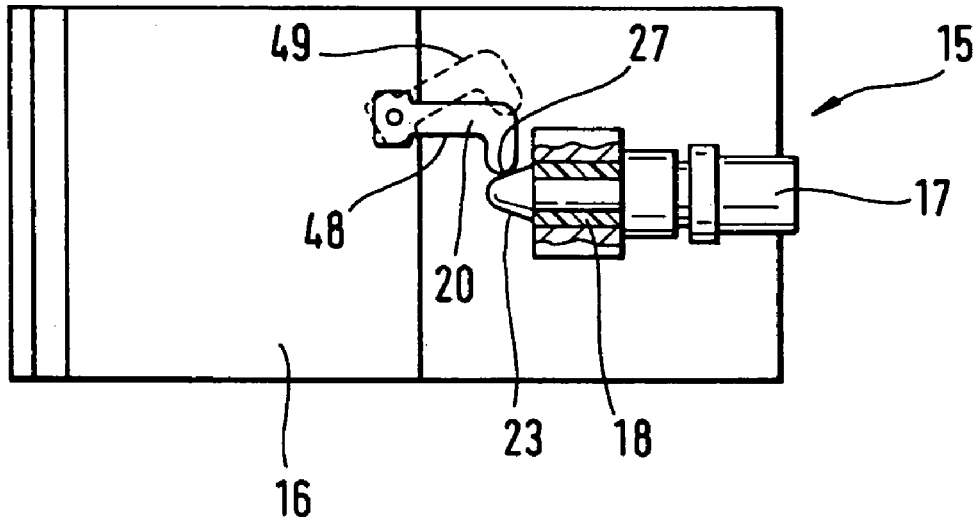
Fig. 3

Fig. 7
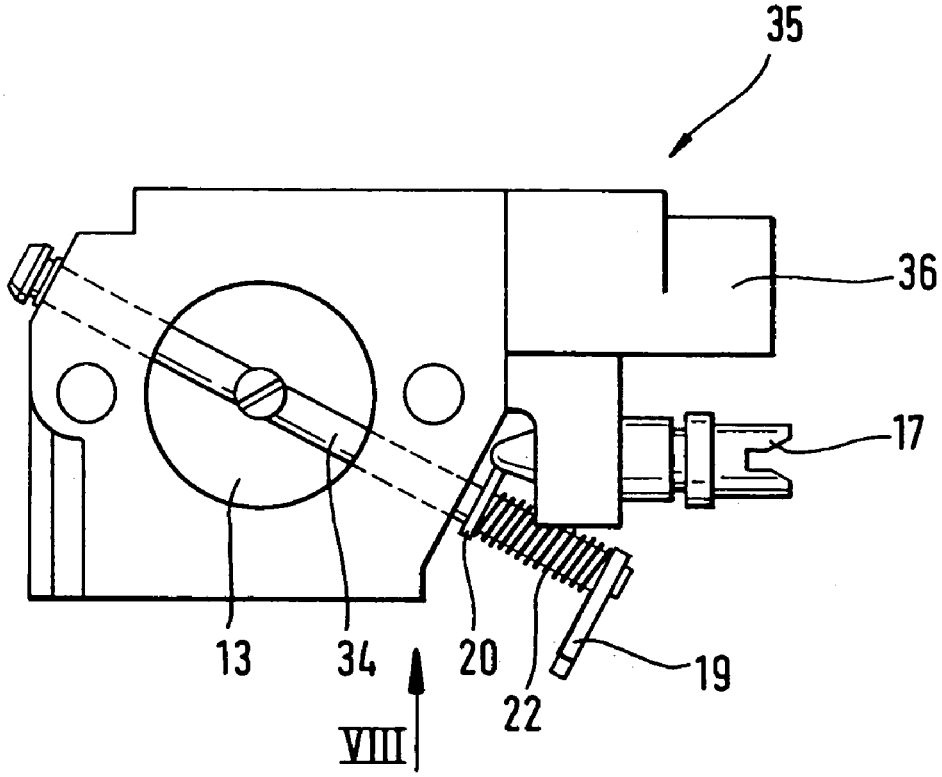
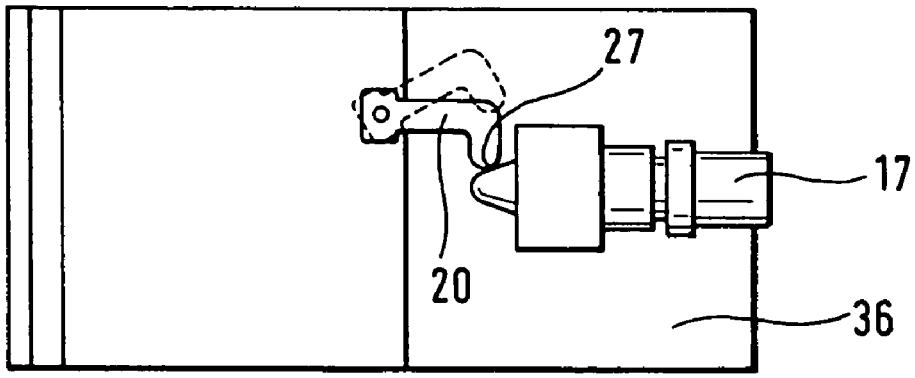
Fig. 8

INTERNAL COMBUSTION ENGINE

BACKGROUND OF THE INVENTION

The present invention relates to an internal combustion engine.

DE 75 19 322 U1 discloses the arrangement of a throttle element in the intake channel of an internal combustion engine. Connected with the throttle element is a lever that in the idling position rests against an idling screw. The idling position of the throttle element can be established via the idling screw.

With internal combustion engines, the ignition timing or time point is adapted to the respective load condition. Thus, for the control of the ignition timing it is necessary to recognize the idling position of the throttle element. With DE 75 19 322 U1, to establish the idling position a pneumatic device is provided that receives the pressure before and after the throttle element and that additionally takes into consideration the position of the gas pedal. Such a device is structurally complicated. By shifting the idling screw, and hence the position of the throttle element during idling, the pressure conditions are also changed, thus necessitating a readjustment of the system.

It is therefore an object of the present invention to provide an internal combustion engine of the aforementioned general type according to which the idling position of the throttle element can be reliably determined in a simple manner.

BRIEF DESCRIPTION OF THE DRAWINGS

This object, and other objects and advantages of the present invention, will appear more clearly from the following specification in conjunction with the accompanying schematic drawings, in which:

FIG. 2 is a side view of a carburetor;

FIG. 3 is a side view of the carburetor of FIG. 2 taken in the direction of the arrow III in FIG. 2;

FIG. 7 is a side view of a carburetor;

FIG. 8 is a side view of the carburetor of FIG. 7 taken in the direction of the arrow VIII in FIG. 7;

SUMMARY OF THE INVENTION

Figure 1:
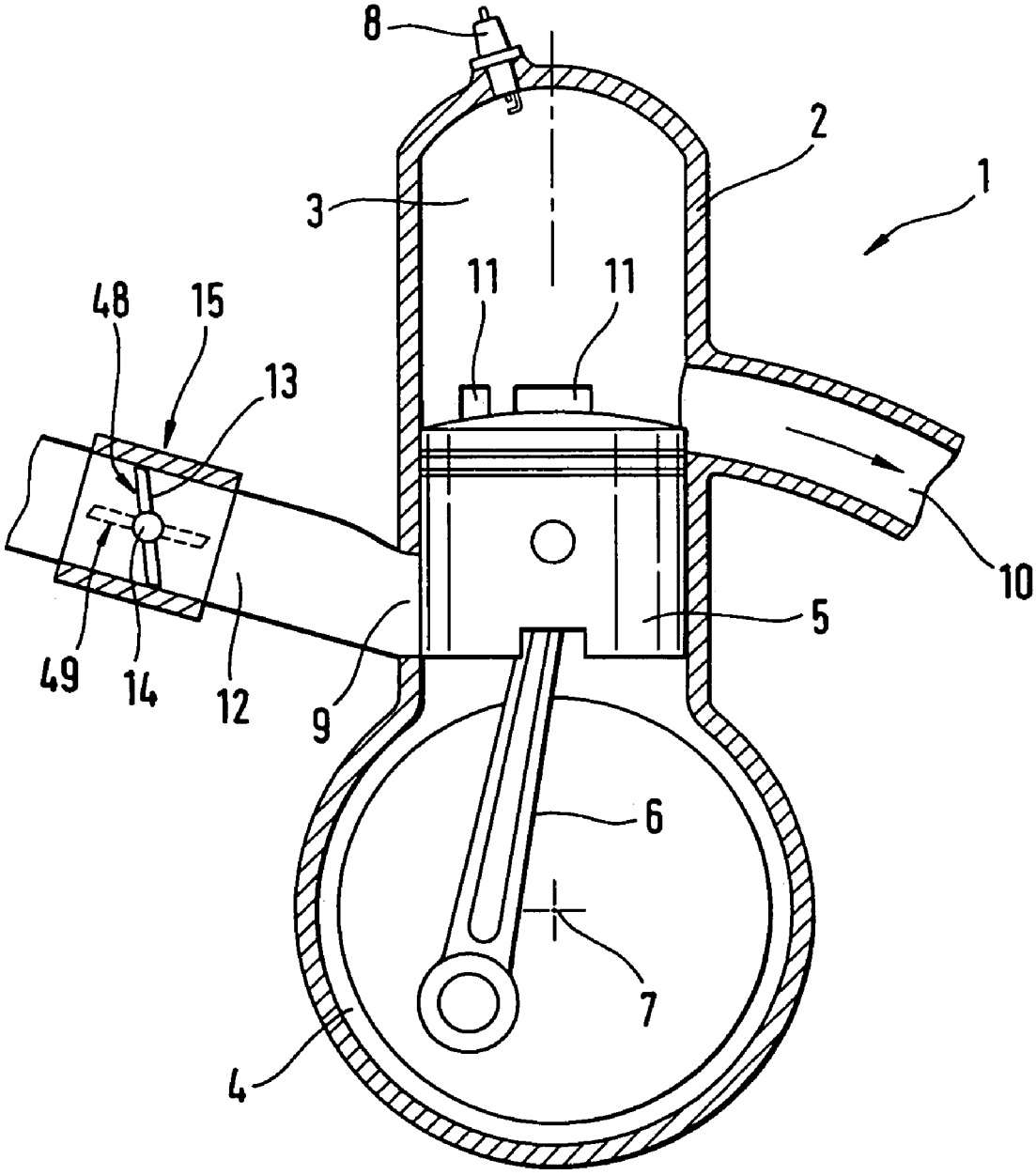
FIG. 1 is a cross-sectional view of one exemplary embodiment of an internal combustion engine of the present application.

The internal combustion engine of the present application comprises a throttle element mounted in the intake channel of the engine so as to be pivotable, via a throttle shaft, between an idling position and a full-load position; in addition, an abutment is fixedly connected with the throttle shaft, wherein in the idling position the abutment rests against a stop element that is fixed in position on the intake channel, wherein the stop element is adjustable and establishes the idling position of the throttle element, and wherein the abutment forms, with the stop element, a switch that is actuated in the idling position of the throttle element.

Thus, pursuant to the present application, the stop element, which establishes the idling position of the throttle element, forms a switch with an abutment that is connected with the throttle shaft. In the idling position of the throttle element, the switch is actuated, so that the idling position is reliably determined. During opening of the throttle element, in other words when the throttle shaft is rotated, the abutment is released from the stop element, so that the switch is opened. Since the stop element itself establishes the idling position of the throttle element, alteration of the idling position does not necessitate a readjustment. Since with conventional internal combustion engines the abutment and the stop element are generally already present, no additional devices are necessary for determining the idling position. The idling position can thus be reliably determined in a simple manner.

The throttle element is advantageously the butterfly valve of the carburetor. The stop element is, in particular, an idling screw. In this connection, the idling screw expediently has a conical portion that cooperates with the abutment. By means of the conical portion of the idling screw, the idling position of the throttle element can be easily and finely adjusted.

The switch is advantageously a pneumatic switch. The abutment is in particular formed by an air jet that can be closed off by the stop element. It can be expedient for the switch to be an electrical switch. In this case, a detection of the idling position can be easily achieved already in that the abutment and the stop element that are present are electrically contacted and are suitably insulated from one another. With a contact between the abutment and the stop element the electrical circuit is closed and the signal can be received in a control means. The throttle shaft is advantageously mounted in a housing and is electrically insulated relative to the housing. However, it can also be expedient for the idling screw to be fixed in position on a housing and to be electrically insulated relative to the housing. The throttle shaft is in particular made of a material that is not electrically conductive. In this case, no additional components are needed for the insulation. The abutment is advantageously electrically insulated relative to the throttle shaft. It can be expedient for the switch to be a mechanical switch. A straightforward embodiment is provided if the switch is provided as a pushbutton or sending key.

In order to also be able to easily determine the full-load position of the throttle element, a second abutment is fixedly connected with the throttle shaft and forms with the stop element a second switch that is actuated in the full-load position. With conventional internal combustion engines, an abutment is also provided for the full-load position, so that also for the determination of the full-load position hardly any additional devices are needed.

It is provided that the switch be connected with the control means. The signal generated by the switch is advantageously utilized for the idling regulation of the internal combustion engine. In this connection, the idling regulation is effected in particular by controlling the ignition timing of the internal combustion engine. However, it can also be expedient to regulate the idling by controlling the fuel/air mixture that is supplied to the internal combustion engine. It can be advantageous to utilize the signal produced by the switch for aiding the acceleration. For this purpose, in particular the signal generated upon opening of the switch is utilized, in other words, when the throttle element departs from the idling position. The signal produced by the switch is advantageously utilized to limit the idling speed of the internal combustion engine. In this connection, the idling speed is limited when the switch is closed, in other words, in the idling position of the throttle element.

The signal produced by the switch expediently forms the input signal for a performance characteristic ignition. In this connection, the ignition timing is regulated, for example, as a function of temperatures and lambda values. Different performance characteristics are utilized during idling, partial load and in full load. In this connection, the signal of the switch serves, together with other parameters, for the selection of a performance characteristic. The signal produced by the switch advantageously activates the brake for a tool driven by the internal combustion engine, and/or switches the brake so as to be free. In this way, one can ensure that the tool does not run during idling. In this connection, the signal generated during closing of the switch serves for the activation of the brake, and the signal generated during the opening of the switch serves for freeing the brake, so that during idling the tool does not run, but is operated when the idling position is left.

Further specific features of the present application will be described in detail subsequently.

DESCRIPTION OF SPECIFIC EMBODIMENTS

Referring now to the drawings in detail, the internal combustion engine 1 that is schematically illustrated in FIG. 1 is embodied as a two-cycle engine. The engine has a cylinder 2, in which is formed a combustion chamber 3. In prescribed positions of a piston 5, the combustion chamber 3 is connected with a crankcase 4. The piston 5 is reciprocably mounted in the cylinder 2 and, via a connecting rod 6, drives the crankshaft 7 that is mounted in the crankcase 4. The internal combustion engine 1 has an intake channel 12 that supplies a fuel/air mixture to the crankcase 4, via an inlet 9, in prescribed positions of the piston 5. The fuel/air mixture is prepared in a carburetor 15. Pivotably mounted in the carburetor 15 is a throttle element, namely a throttle or butterfly valve 13, via a throttle shaft 14. The butterfly valve 13 is movable between the idling position 48, in which it substantially closes off the intake channel 12, and the full-load position 49, which is illustrated by dashed lines in FIG. 1 and in which the butterfly valve influences the flow in the intake channel 12 only in an immaterial manner.

During operation of the internal combustion engine 1, in the region of the upper dead center position of the piston 5 a fuel/air mixture is drawn into the crankcase 4 out of the intake channel 12. With a movement of the piston 5 in a direction toward the crankcase 4, the fuel/air mixture is compressed in the crankcase and in the position of the piston 5 illustrated in FIG. 1 flows through the transfer channels 11 into the combustion chamber 3. The fuel/air mixture is compressed in the combustion chamber 3 and is ignited by the spark plug 8 in the region of the upper dead center position of the piston 5. The exhaust gases subsequently exit the combustion chamber 3 via the outlet 10.

The point in time when the fuel/air mixture in the combustion chamber 3 is ignited by the spark plug 8 is controlled by an ignition timing control means. The ignition timing is controlled as a function of the position of the butterfly valve 13. For example, the ignition in the full-load position 49 is effected later than in the idling position 48. To shift the ignition from the normal point in time to an earlier ignition timing during idling, the idling position 48 of the butterfly valve 13 must be determined, and an appropriate signal must be supplied to the ignition timing control means.

Illustrated in FIG. 2 is a carburetor 15 having a device for determining the idling position 48 of the butterfly valve 13. The butterfly valve 13 is pivotably mounted in the carburetor housing 16 via the throttle shaft 14. In this connection, the butterfly valve 13 is spring-suspended in a direction toward its idling position via a torsion spring 22. The torsion spring 22 is disposed externally of the carburetor housing 16, and is supported via one leg on the butterfly valve lever 19 and via the other leg on the carburetor housing 16. A gas pedal or lever can engage the butterfly valve lever 19. A lever 20 is fixedly coupled with the throttle shaft 14.

As shown in FIG. 3, the lever 20 has an abutment 27 that, in the idling position 48 of the throttle shaft 14, rests against a conical portion 23 of an idling screw 17. By rotating the idling screw 17, the position of the abutment 27 on the conical portion 23 can be altered, thus also altering the position of the butterfly valve 13 in the idling position. With the full-load position 49 of the butterfly valve 13, as illustrated by dashed lines in FIG. 3, the abutment 27 is raised from the idling screw 17. The idling screw 17 is mounted on the carburetor housing 16 via an insulating sleeve 18. The idling screw 17 and the carburetor housing 16 are connected with the control unit or means 30 via electrical lines 29. By means of the control means 30, when a voltage is applied it can be determined whether the butterfly valve 13 is in the idling position. This is the case if the abutment 27 rests against the conical portion 23 of the idling screw 17 and the electrical circuit is thus closed.

Figure 4:
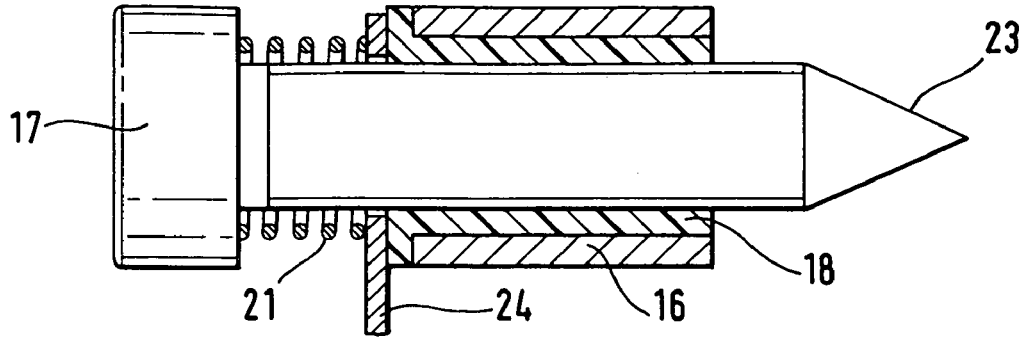
FIG. 4 is an enlarged cross-sectional view through an idling screw.

FIG. 4 is an enlarged view of the idling screw 17. The idling screw 17 is mounted in a spring-suspended manner via a compression spring 21. The insulating sleeve 18 is disposed between the carburetor housing 16 and the idling screw 17. The idling screw 17 has an electrical connection 24 for a connection with a voltage source in the control means 30. In this connection, during opening and/or closing the switch produces a signal that is supplied to the control means 30.

Figure 5:
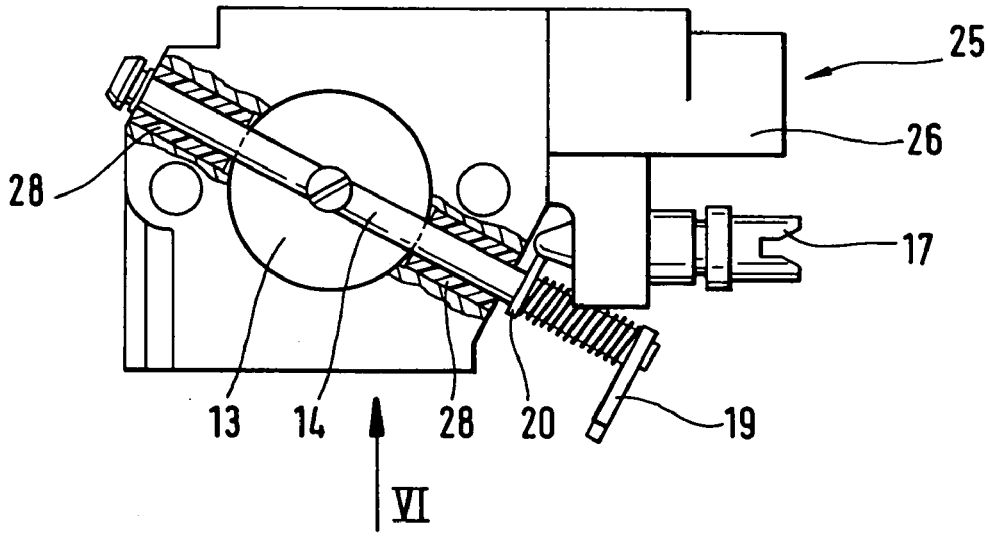
FIG. 5 is a side view of a carburetor.
Figure 6:
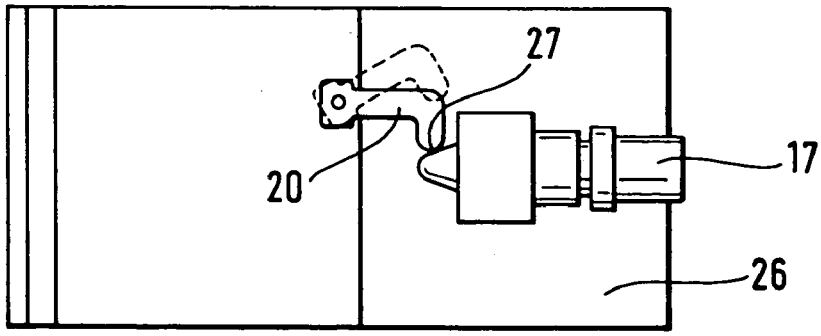
FIG. 6 is a side view of the carburetor of FIG. 5 taken in the direction of the arrow VI in FIG. 5.

A modified embodiment of a carburetor 25 is illustrated in FIGS. 5 and 6. The same reference numerals as in FIGS. 1 to 4 are used to indicate the same components. The carburetor 25 has a carburetor housing 26 in which the throttle shaft 14 is mounted via insulating sleeves 28. The throttle shaft 14 is thus electrically insulated relative to the carburetor housing 26. The idling screw 17 is mounted in the carburetor housing 26 and is connected via this housing with a voltage supply. The throttle shaft 14 is electrically contacted by a non-illustrated electrical connection, so that the drop in voltage, which results when the abutment 27 rests against the idling screw 17, can be determined. As a result, the idling position of the butterfly valve 13 is determined.

A further exemplary embodiment is illustrated in FIGS. 7 and 8. The carburetor 35 has a carburetor housing 36 in which a throttle shaft 34 is rotatably mounted. The idling screw 17 is held in the carburetor housing 36. The throttle shaft 34 is made of a material that is electrically non-conductive, so that by contacting the lever 20 and the housing 36, or the idling screw 17, it can be determined whether the butterfly valve 13 is in the idling position.

Figure 12:
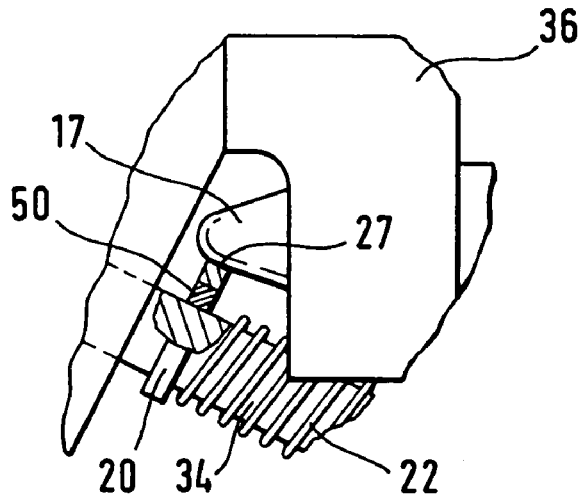
FIG. 12 is a partial cross-sectional view of a portion of a carburetor.

FIG. 12 shows an embodiment according to which the lever 20 is electrically insulated relative to the throttle shaft 34 via an insulating means 50, so that the abutment 27 is electrically insulated relative to the throttle shaft 34. By contacting the lever 20 and the throttle shaft 34, the carburetor housing 36, or the idling screw 17, the idling position of the butterfly valve can be determined.

Figure 9:
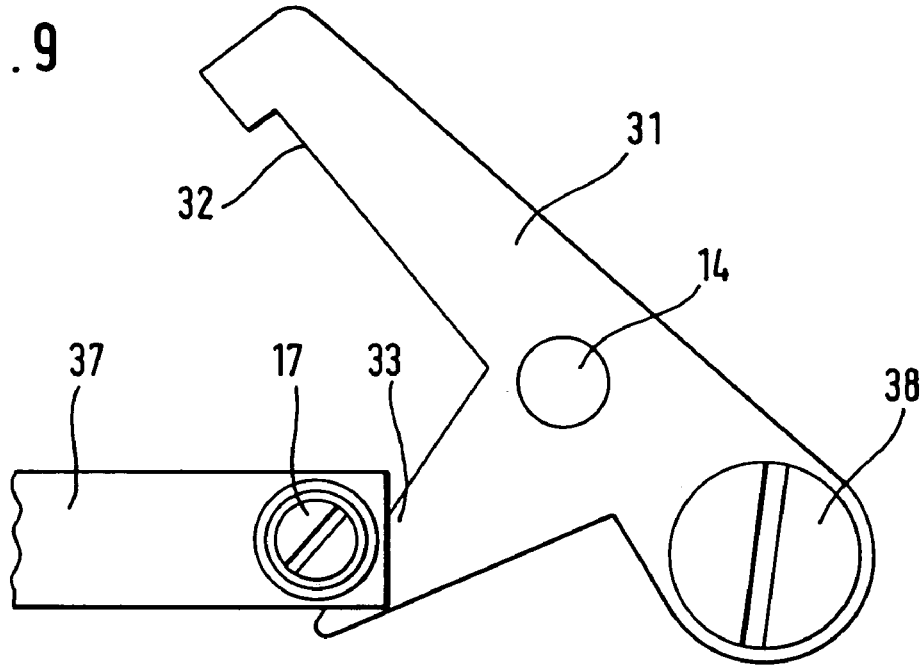
FIG. 9 is a side view of a lever connected with the throttle shaft.

The plan view of FIG. 9 shows a lever 31 that is fixedly connected with the throttle shaft 14 and that cooperates with the idling screw 17. The idling screw 17 is mounted in a carburetor housing 37 and is embodied in conformity with the idling screw illustrated in FIG. 4. The lever 31 has a first abutment 32 that in the idling position of the butterfly valve 13 rests against the conical portion 23 (not illustrated in FIG. 9) of the idling screw 17. The first abutment 32 thus forms a first switch with the idling screw 17. The lever 31 has a second abutment 33 that in the full-load or throttle position of the butterfly valve 13 rests against the idling screw 17 and forms a second switch with this idling screw. Thus, by contacting the lever 31 not only the full-load position but also the idling position of the butterfly valve 13 can be determined. For a differentiation between the two positions, the speed of the engine can, for example, be utilized. Disposed on the lever 31 is a fastening means 38 for the attachment of the gas pedal or lever.

Figure 10:
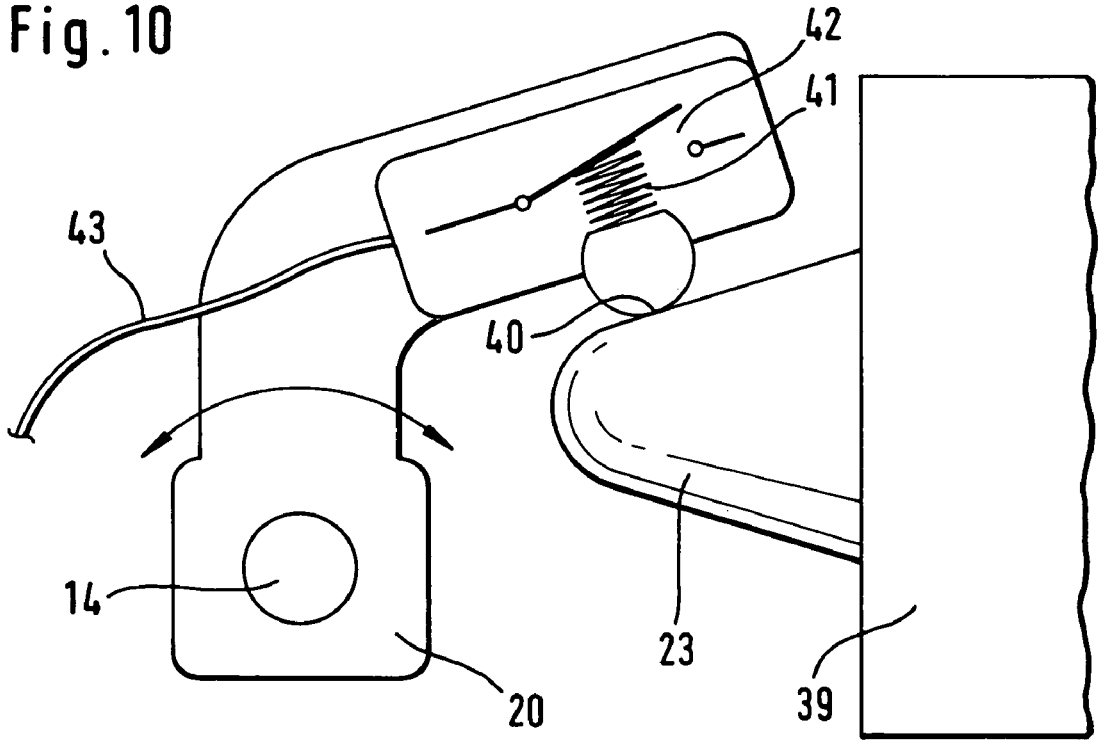
FIG. 10 is a schematic illustration of a mechanical switch.

FIG. 10 schematically shows the embodiment of a mechanical switch that is in the form of a pushbutton or sending key. The idling screw 17, of which only the conical portion 23 is illustrated, is mounted in a carburetor housing 39. A lever 20, which is fixedly connected with the throttle shaft 14, has a line 43 in which is formed an electrical contact 42. By means of a spring 41, an abutment 40 is mounted at the electrical contact 42. In the idling position of the butterfly valve 13, the abutment 40 rests against the conical portion 23 of the idling screw. The electrical contact 42 is thereby opened, thus interrupting the electrical circuit in the line 43. This signal can be conveyed to the ignition timing control means. When the lever 20 is raised from the idling screw 17, the electrical contact 42 is closed and the control means can recognize that the butterfly valve is no longer in the idling position.

Figure 11:
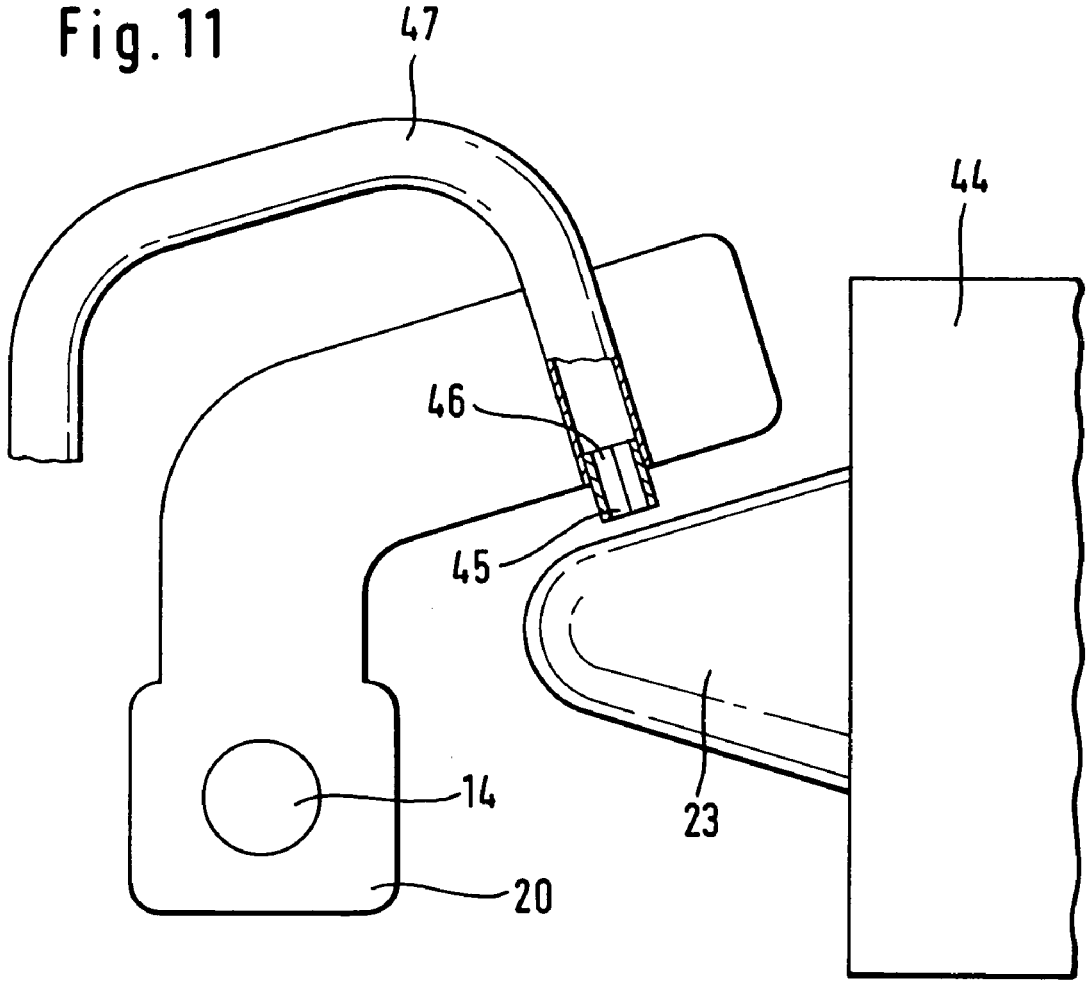
FIG. 11 is a schematic illustration of a pneumatic switch.

FIG. 11 schematically shows the embodiment of a pneumatic switch. The conical portion 23 of the idling screw 17 is fixed in position against a carburetor housing 44. An air supply line 47 is disposed on the lever 20, which is fixedly connected with the throttle shaft 14. The air supply line 47 is oriented in such a way that an air jet 46 forms an abutment 45 that cooperates with the conical portion 23. In this connection, the abutment 45 is closed by the conical portion 23 in the idling position of the butterfly valve 13. The thereby resulting increase in pressure can be determined, and the signal can be conveyed to the ignition timing control means.

The signal of the switch can be utilized for the regulation of the idling, not only by control of the ignition timing but also by mixture control. The control of the ignition timing is advantageously electronically effected via software, especially via a software-implemented PI controller. By using the signal generated by the opening of the switch to aid in acceleration, it is possible when departing from the idling position to change to an earlier ignition timing. It is also possible, for aiding the acceleration, to make the mixture richer or to activate an accelerator pump. The signal can be used for regulating the idling, so that the idling speed can be effectively limited and it can be ensured that during idling, for example, a tool that is driven by the internal combustion engine cannot also run. To prevent sparks from forming during idling at the exhaust gas muffler, and especially in a catalytic converter, when certain speeds of the engine are exceeded the engine is regulated down. To recognize the idling, the signal generated by the switch can be utilized. The signal generated by the switch can in particular also form the input signal for a performance characteristic ignition, for example as a function of temperatures and lambda values. In this connection, it is in particular provided that different performance characteristics be utilized in idling, partial throttle and full throttle. When the internal combustion engine is used in a manually guided implement, such as a power chain saw, a cut-off machine, or the like, it is expedient in the idling position of the butterfly valve to activate the brake for the tool or implement, thus reliably preventing the tool from running during idling. The signal generated when the switch is closed can thus be utilized for the activation of the brake. When the switch is opened, the brake is released by the signal of the switch. Furthermore, the signal of the switch can be utilized as a signal for cold starting, in other words, starting at half throttle.

In the embodiment, the switch at the butterfly valve was described for a two-cycle engine; however, use with other engines, for example four-cycle engines, can also be advantageous.

The specification incorporates by reference the disclosure of German priority document 103 26 313.6 filed Jun. 6, 2003.

The present invention is, of course, in no way restricted to the specific disclosure of the specification and drawings, but also encompasses any modifications within the scope of the appended claims.

We claim:

1. An internal combustion engine having an intake channel, comprising:

a throttle element mounted in said intake channel so as to be pivotable, via a throttle shaft, between an idling position and a full-load position;

an abutment fixedly connected with said throttle shaft;

a stop element that is fixed in position on said intake channel, wherein in said idling position said abutment rests against said stop element, wherein said stop element is adjustable, wherein said stop element establishes said idling position of said throttle element, and wherein the position of said throttle element in said idling position is adapted to be altered by adjusting said stop element; and a switch that is actuated in said idling position of said throttle element, wherein said switch is formed by said abutment and said adjustable stop element, which establishes said idling position, so that said idling position is adapted to be reliably determined.

2. An internal combustion engine according to claim 1, wherein said throttle elememt is a butterfly valve of a carburetor.

3. An internal combustion engine according to claim 1, wherein said stop element is an idling screw.

4. An internal combustion engine according to claim 3, wherein said idling screw is provided with a conical portion that cooperates with said abutment.

5. An internal combustion engine according to claim 1, wherein said switch is a pneumatic switch.

6. An internal combustion engine according to claim 5, wherein said abutment is formed by an air jet that is closable by said stop element.

7. An internal combustion engine according to claim 1, wherein said switch is an electrical switch.

8. An internal combustion engine according to claim 7, wherein said throttle shaft is mounted in a housing and is electrically insulated relative to said housing.

9. An internal combustion engine according to claim 7, wherein said stop element is an idling screw that is fixed in position on a housing and is electrically insulated relative to said housing.

10. An internal combustion engine according to claim 7, wherein said throttle shaft is made of a material that is electrically non-conductive.

11. An internal combustion engine according to claim 7, wherein said abutment is electrically insulated relative to said throttle shaft.

12. An internal combustion engine according to claim 1, wherein said switch is a mechanical switch.

13. An internal combustion engine according to claim 12, wherein said switch is embodied as a pushbutton or sending key.

14. An internal combustion engine according to claim 1, wherein a second abutment is fixedly connected with said throttle shaft, and wherein a second switch is formed with said stop element and is actuated in said full-load position.

15. An internal combustion engine according to claim 1, wherein said switch is connected with a control unit.

16. An internal combustion engine according to claim 1, wherein a signal produced by said switch is utilizable for regulating idling of said internal combustion engine.

17. An internal combustion engine according to claim 16, wherein said idling is regulated by control of an ignition time point of said internal combustion engine.

18. An internal combustion engine according to claim 16, wherein said idling is regulated by control of a fuel/air mixture supplied to said internal combustion engine.

19. An internal combustion engine according to claim 1, wherein a signal produced by said switch is utilized for aiding acceleration.

20. An internal combustion engine according to claim 1, wherein a signal produced by said switch is utilizable for limiting an idling speed of said internal combustion engine.

21. An internal combustion engine according to claim 1, wherein a signal produced by said switch forms an input signal for a performance characteristic ignition.

22. An internal combustion engine according to claim 1, wherein a signal produced by said switch effects at least one of an activation or a freeing of a brake for a tool that is adapted to be driven by said internal combustion engine.

* * * * *